US005917398A

United States Patent [19]

Kunz et al.

[11] Patent Number: 5,917,398

[45] Date of Patent: Jun. 29, 1999

[54] REED CONTACT UNIT FOR AN ELECTRIC SWITCH

[75] Inventors: Hans Peter Kunz, Breitscheid; Stefan Markfort, Trechtingshausen, both of Germany

[73] Assignee: Eaton Corporation, Cleveland, Ohio

[21] Appl. No.: 09/003,678

[22] Filed: Jan. 7, 1998

[30] Foreign Application Priority Data

Jan. 11, 1997 [DE] Germany ..... 197 00 726

[51] Int. Cl.[6] ..... H01H 1/66; H01H 51/00; H01H 50/00

[52] U.S. Cl. ..... 337/98; 337/54; 337/134; 337/366; 335/151; 335/154; 324/419

[58] Field of Search ..... 337/1, 12, 26, 337/29, 54, 98, 109, 122, 134, 137, 329, 366, 373, 413, 298; 335/151, 154; 200/80 B; 324/419; D13/176, 172

[56] References Cited

U.S. PATENT DOCUMENTS

| | | | |
|---|---|---|---|
| D. 235,559 | 6/1975 | Shlesinger, Jr. | D13/3 |
| D. 235,561 | 6/1975 | Shlesinger, Jr. | D13/3 |
| D. 236,494 | 8/1975 | Shlesinger, Jr. | D13/3 |
| D. 236,496 | 8/1975 | Shlesinger, Jr. | D13/3 |
| D. 236,497 | 8/1975 | Shlesinger, Jr. | D13/3 |
| D. 236,498 | 8/1975 | Shlesinger, Jr. | D13/3 |
| 2,985,733 | 5/1961 | Kamps | 335/202 |
| 3,031,550 | 4/1962 | Morrison | 335/199 |
| 4,160,223 | 7/1979 | Morrill, Jr. et al. | 335/152 |
| 4,292,614 | 9/1981 | Ono et al. | 335/202 |
| 4,573,030 | 2/1986 | Schubert | 335/156 |

FOREIGN PATENT DOCUMENTS

| | | | |
|---|---|---|---|
| 403283226 | 12/1991 | Japan | H01H 51/24 |

*Primary Examiner*—Leo P. Picard
*Assistant Examiner*—Anatoly Vortman
*Attorney, Agent, or Firm*—Roger A. Johnston

[57] ABSTRACT

The invention relates to a reed contact unit (1) for electric switching functions, comprising a metallic contact blank (2) featuring a base (3) with at least one contact arm (5) configured integral with it, and comprising an electrically non-conducting frame part (7) accommodating fixedly the base (3) of the contact blank (2). To avoid deformations and damage to the contact arms (5) of the reed contact units (1) when used in bulk, at least one of the long sides (12) and the front end (9) of the contact arm (5) are surrounded by at least one frame shank (8) configured integral with the frame part (7), the front end (9) of the contact arms (5) being fixable releasably in the frame shank (8).

15 Claims, 4 Drawing Sheets

REED CONTACT UNIT FOR AN ELECTRIC SWITCH

BACKGROUND OF THE INVENTION

The invention relates to a reed contact unit for electric switching functions.

To realize various electric switching functions, notably in the electrical system of an automobile, a plurality of contact elements are used. Their design is normally relatively simple, in order to minimize production costs. Such switching contact elements consist essentially of a contact blank whose base is fixedly molded in plastic. Coincident openings in the base part of the contact blank and in the frame part surrounding it make it possible to fasten the switching contact element to another component. Provided on the base of the contact blank are one or several contact arms extending away from it and formed integral with the base of the contact blank. The contact arms jut out of the base of the contact blank freely and without protection. In the mass production of such switching contact elements, these are placed in bulk into a container; and, the contact arms of the many jumbled contact elements get tangled. This results in bent contact arms, which requires mostly a manual touchup or makes them unusable.

The contact arms are frequently divided in reed contact pairs separated by a clearance, increasing the risk of tangling and bending of the reed contacts or contact arms further. This results in more switching elements being unusable for further assembly.

The reed contacts or contact arms are, prior to their assembly or molding, normally subjected to a bending operation so as to make a sound contact surface available for the mating component. These bends on the reed contacts or contact arms also contribute considerably to the tangling of the switching contact elements or to their being no longer usable.

Therefore, the objective underlying the invention is to create a reed contact unit of the initially named type where bending and damage to the contact arms, notably in the bulk usage of the reed contact unit, are avoided while their handling is improved.

BRIEF SUMMARY OF THE INVENTION

The invention comprises a metallic contact blank featuring a base part with at least one contact arm formed integrally with it, and comprising an electrically non-conducting frame fixedly housing the base of the contact blank.

The foregoing objective is satisfied according to the invention in that at least one of the long sides and the front end of the contact arm are surrounded by at least one frame shank configured integral with the frame part, with the front end of the contact arm releasably fixed in the frame shank.

The construction of the present invention protects each contact arm along at least one of its long sides and its front end by the frame shank in conjunction with the pertaining frame part, thereby preventing the contact arms from engaging the contact arms of other reed contact units contained loosely in a container. Each contact arm of the contact blank has a frame molded to it throughout its entire length and particularly throughout the length of the contact arms. This allows handling a plurality of reed contact units in bulk, the contact arms remaining protected until their assembly and thus being able to fulfill their function as a reed contact or wiping contact. Because the reed contact units can no longer get entangled with others, they can be used in fully automatic assembly. With the frame shank backing the contact arm relative to the frame part, there is no torsional moment transmitted between them; but, a backing of the contact arms relative to the base is realized in conjunction with the frame part, enabling the contact arm to absorb the relevant contact force created in the assembly of the reed contact unit. This also allows multiple use of the reed contact unit, as it is subjected to considerably reduced wear. The contact blank may feature a plurality, for example 2, 3, 4, 5, etc., of contact arms, all of which are protected by the frame shank formed on the frame part. Moreover, several contact blanks may be accommodated in a single frame part, to realize several circuits and achieve circuit-related advantages.

In improving the invention further, the frame shank section fixing the front end of the contact arm is provided with a groove accommodating the front end of the contact arm. This groove has relatively slight depth, so that the contact arm front end just fits in. This makes it very easy, when the contact arm is needed for assembly, to release it from the groove, by exerting a slight pressure and lifting it from the frame shank. Nonetheless, the groove guarantees that the relevant contact arm will not come loose by itself in the bulk storage of the reed contact unit.

To guarantee a free mobility of the contact arm in the assembly of the reed contact unit, the respective long side of the contact arm is preferably surrounded by the frame shank by formation of a clearance.

Prior to the assembly of the reed contact unit, the front end of the contact arm can be disengaged from the frame shank by bending. Producing a bend in the contact arm reduces automatically its exposed length (cantilever), whereby the front end of the contact arm slips out of the groove and a clearance is formed between the front end of the contact arm and the respective frame shank. The contact arm can in this state be bent out of the frame shank area surrounding it. Hence, the reed contact unit is in a state in which it can be assembled to an appropriate component.

According to one embodiment of the invention, the at least one contact arm is on both of its long sides and its front end surrounded by frame shanks. This guarantees protection of the contact arm both on its two long sides and on its front end. According to another embodiment of the invention, the frame shank formed on the frame part is L-shaped. In this embodiment, besides the front end, only one long side of the contact arm is protected here. In many applications this arrangement is sufficient to avoid tangling with adjacent parts of other reed contact units. According to a further embodiment of the invention, the frame shank formed on the frame part is T-shaped. This T-shaped frame shank is contained between two adjacent contact arms of a contact pair of a contact blank. Protected here as well is only one long side of the contact arm and its front end. The T-shaped frame shank essentially corresponds to a symmetric arrangement of two L-shaped frame shanks. In all of these embodiments of the invention several contact arms may be arranged in the area of a frame shank.

The frame part and the at least one frame shank preferably consists of plastic and are molded to the base or around the at least one contact arm of the contact blank. This represents the most economical production and design form of the reed contact unit. Jointly with the frame shank, the frame part can be molded to the contact blank in a single operation, thereby protecting the contact arms of the contact blank and firmly surrounding the base part of the contact blank.

Many applications may require that the frame shank can be broken away from the frame part during an assembly operation of the reed contact unit. For that purpose, a notch is provided between the frame part and the frame shank. The notch may form an area sufficiently weak for the frame shank to break off automatically in the assembly of the reed contact unit, since its protective function is fulfilled with the assembly of the reed contact unit.

Alternatively, the frame part or frame shank may, in the assembly operation or subsequent use of the reed contact unit, be intended as a backing or guide element in an appropriate component, so that the frame shank is configured appropriately rigid in relation to the frame part. The frame shank fulfills thus, besides its protective function, additionally the function of an assembly aid in the installation of the reed contact unit and/or a guiding or mounting for the function proper.

All of the illustrated advantages, of course, apply also to the contact arms, which are divided in at least two reed contacts extending parallel to each other.

As a further improvement of the inventional idea, several or a plurality of reed contact units may be combined in a strip or stamped pattern where each of said reed contact units can be broken off or separated from the strip or stamped pattern. The strip or stamped pattern suitably contains for that purpose notches that separate the reed contact units. This arrangement allows in a number of applications an automatic feeding and handling of the reed contact units, thereby improving the economy of their production and processing considerably.

It is understood that the features mentioned above and to be illustrated yet hereafter are usable not only in the stated combination, but also in other combinations or by themselves, without leaving the scope of the present invention.

The invention is more fully described hereafter with the aid of several exemplary embodiments with reference to the pertaining drawings.

DETAILED DESCRIPTION OF THE INVENTION

Figure 1:
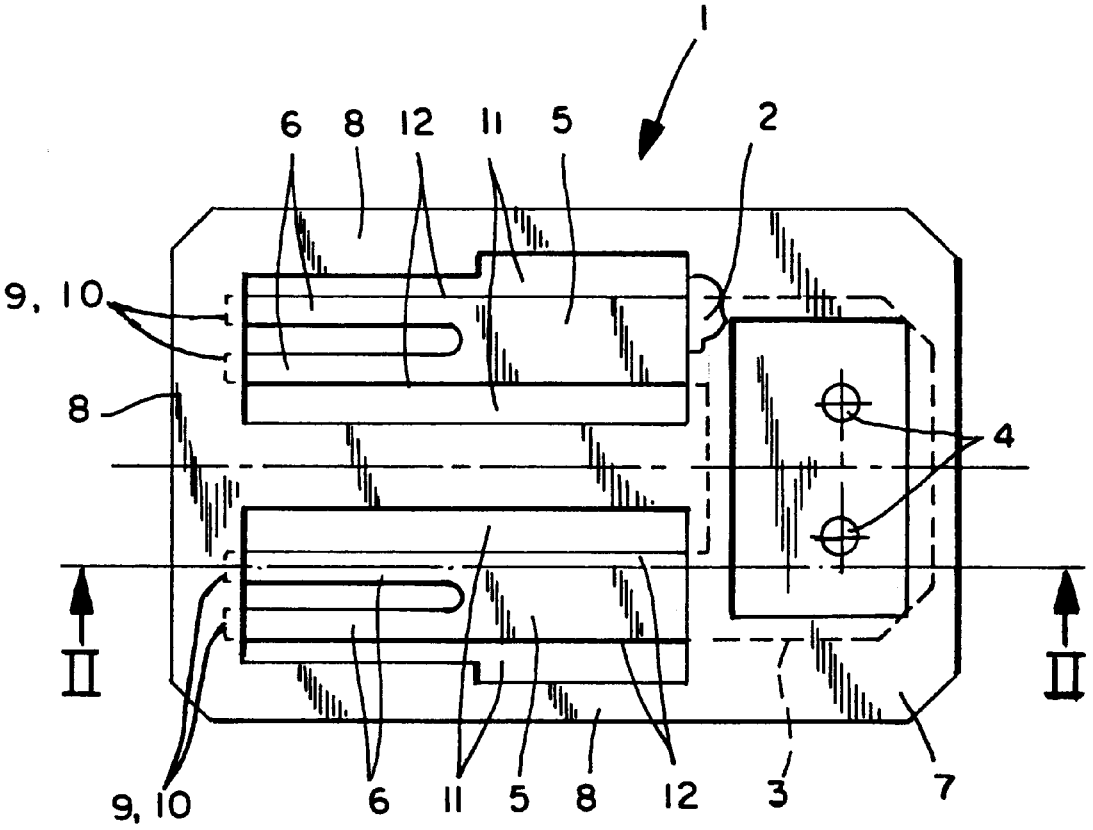
FIG. 1 is a plan view of an inventional reed contact unit.

The reed contact unit 1 according to FIGS. 1 through 4 features a contact blank 2 of metallic material. A base 3 of the contact blank 2 possesses two spaced holes 4 for securing the reed contact unit 1 to an associated, not illustrated component. Bordering on the base 3 are two spaced contact arms 5 which are integral with the base 3. The contact arms 5 are split in their front area, forming two reed contacts each as denoted by reference numeral 6.

The contact blank 2 is circumscribed by a frame part 7 and frame shanks 8, each consisting of plastic and molded integrally over the contact blank 2. The frame part 7 is fixedly joined to such as by molding over the base 3 of the contact blank 2, exposing the holes 4 in the base 3 of the contact blank 2.

Figure 2:
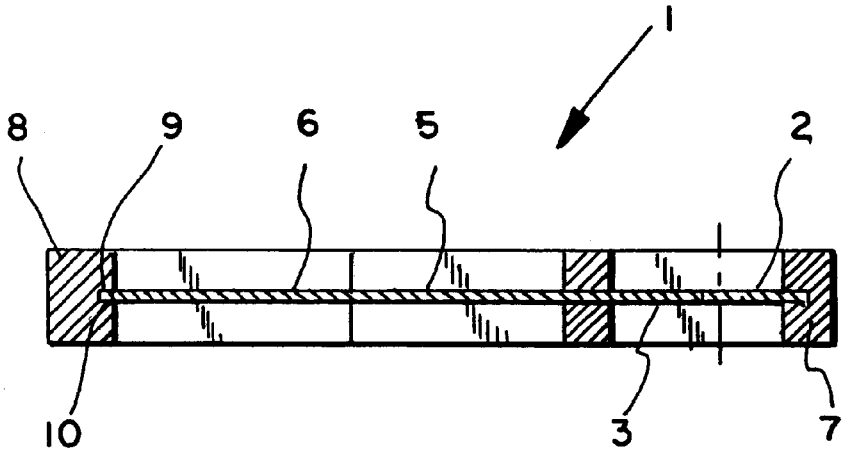
FIG. 2 is a cross-sectional view taken along section indicating line II—II in FIG. 1.

The frame shanks 8 form a unit with frame port 7 and protrude therefrom and surround the contact arms 5 and reed contacts 6, respectively, such that the front or left hand ends 9 of the reed contacts 6 engage freely matching grooves 10 in the frame shank 8 opposite the frame part 7. The lateral frame shanks 8 each form a clearance 11 between themselves and the long sides 12 of the contact arms 5. The groove 10 in the respective frame shank 8 is configured such that the front end 9 of the reed contact 6 can be locked releasably. This state of the reed contact unit 1 is illustrated in FIG. 1 and 2.

Figure 3:
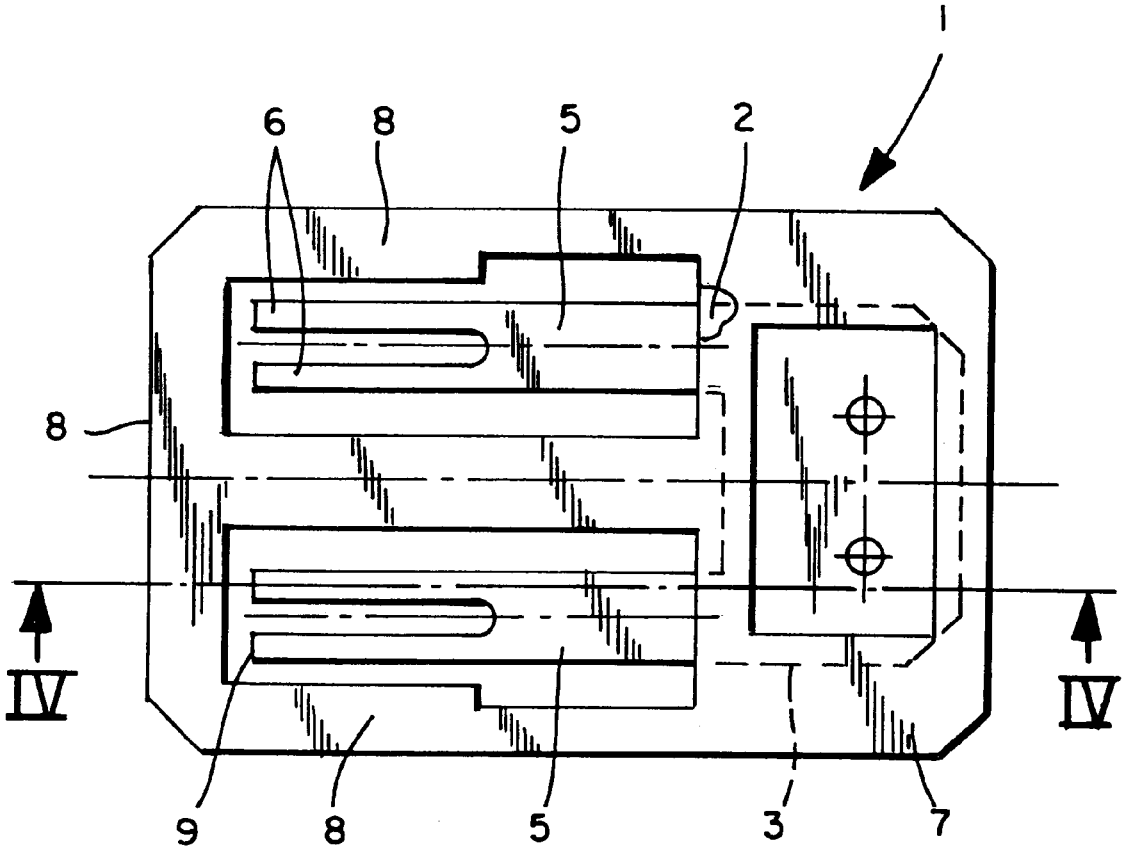
FIG. 3 is a plan view of a reed contact unit immediately before its assembly.
Figure 4:
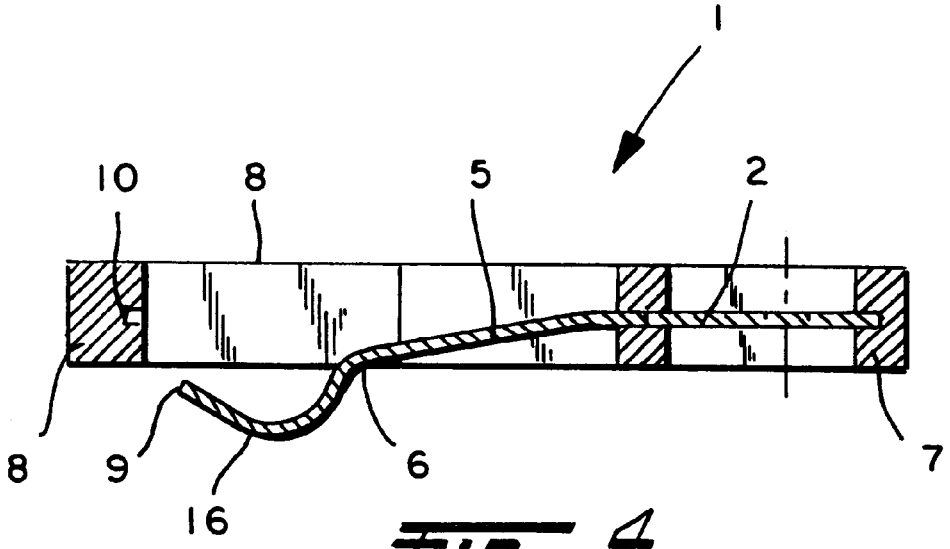
FIG. 4 is a cross-sectional view along line IV—IV in FIG. 3.

FIGS. 3 and 4, in contrast, show the reed contact unit 1 in which the front ends 9 of the reed contacts 6 of the contact arms 5 have been subjected to bending at 16. Moreover, their contact arms 5 are for assembly purposes pushed down, out of the plane of the frame shanks 8 surrounding them. Since the front end 9 of each reed contact 6 is provided with a bend 16, the front end 9 of the reed contact 6 has automatically moved out of the groove 10, whereby the bend 16 has caused a reduction of the exposed length (cantilever) of the contact arm 5. In this state, the reed contact unit 1 is freely available for assembly to a associated component.

Figure 5:
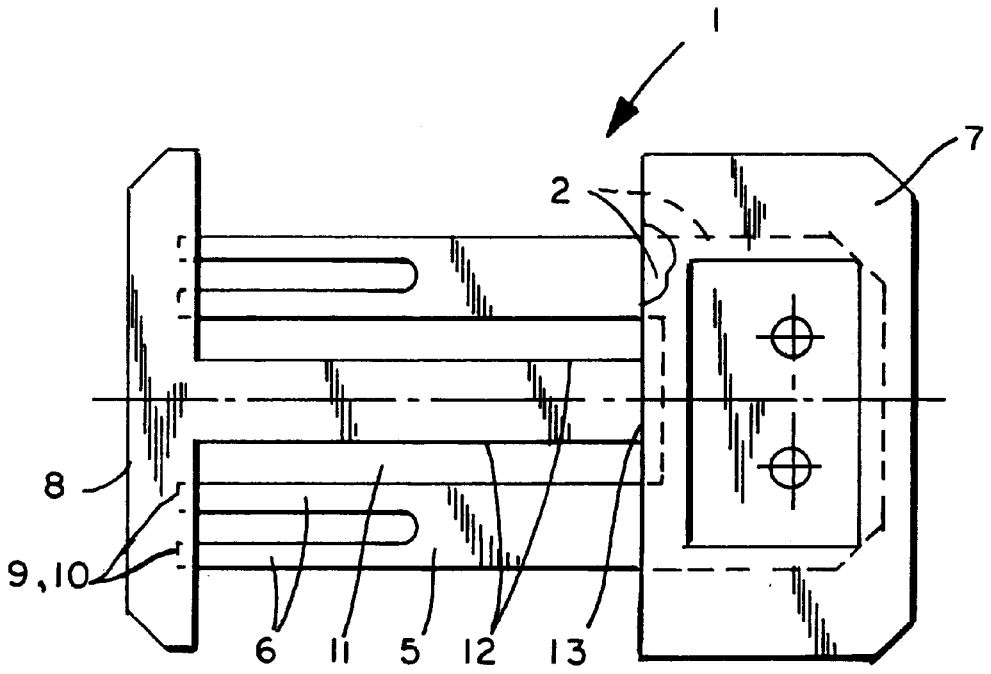
FIG. 5 is a plan view of another embodiment of a reed contact unit according to FIG. 1.

FIG. 5 shows the reed contact unit 1 with a frame shank 8 of T-shaped configuration arranged on the frame part 7. In the embodiment of FIG. 5 only the inner length side 12 of the contact arms 5 and the front ends of the reed contacts 6 of a contact blank 2 are surrounded here by a frame shank 8.

Figure 6:
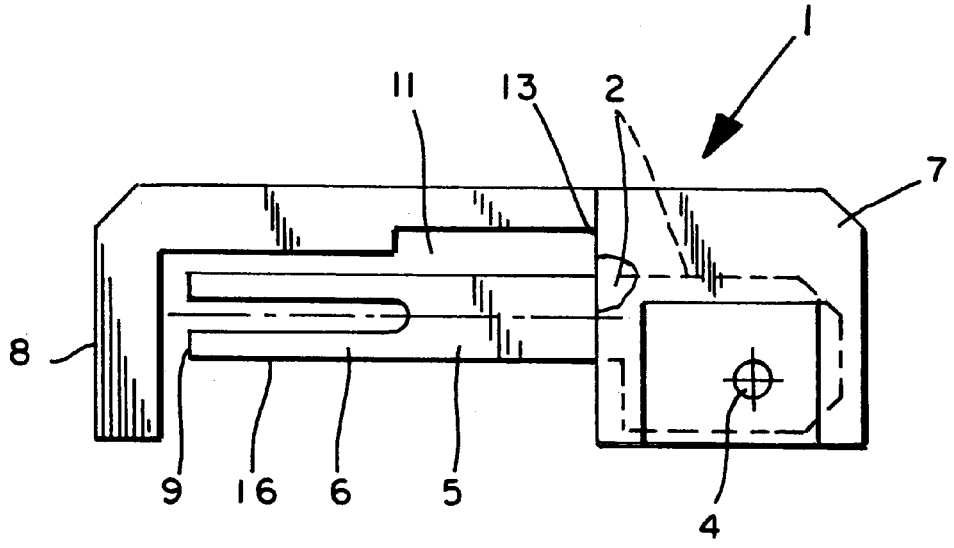
FIG. 6 is a further alternative embodiment of the reed contact unit according to FIG. 3.

FIG. 6 shows an alternative embodiment in which the reed contact unit 1 has only one contact arm 5 which is provided with a bend 16, so that its front end does not engage the L-shaped frame shank 8. The T-shaped frame shank 8 according to FIG. 5 and the L-shaped frame shank 8 according to FIG. 6 may be attached to the frame part 7 as a knockout, with a notch 13 fashioned between the frame part 7 and frame shank 8.

Figure 7:
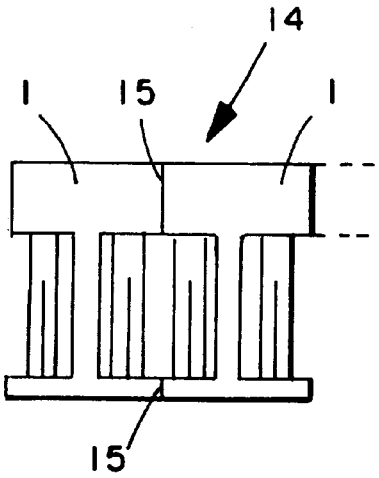
FIG. 7 is a schematic illustration of several reed contact units combined in a strip.
Figure 8:
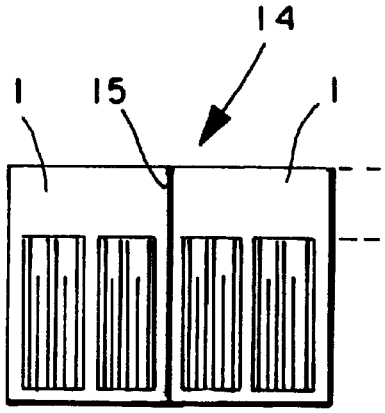
FIG. 8 is an alternative embodiment of a strip with reed contact units according to FIG. 7.
Figure 9:
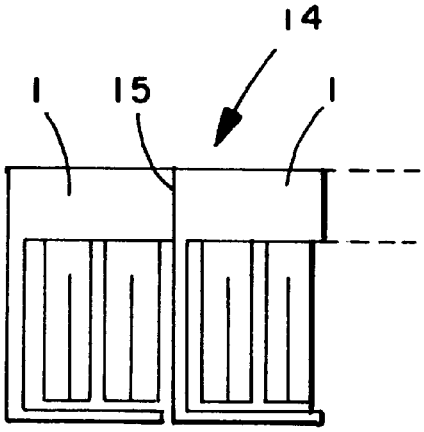
FIG. 9 is a further alternative embodiment of a strip with reed contact units according to FIG. 7.

FIGS. 7 through 9 show schematically a strip 14 consisting of a plurality of reed contact units 1 which are arranged serially thereon and which can be separated by means of a notch 15. According to the embodiment of FIG. 7, the frame shanks 8 of the reed contact units 1, the same as in the FIG. 5 embodiment, are of T-shaped configuration and each circumscribe the inner long side of two adjacent contact arms of a contact blank. FIG. 8 shows an embodiment according to FIG. 1, but with a contact blank featuring several contact arm pairs divided in reed contacts. FIG. 9 shows a row of reed contact units 1 relative to FIG. 6, with the L-shaped frame shank of each reed contact unit 1 surrounding a pair of contact arms.

Although the invention has hereinabove been described with respect to the illustrated embodiments, it will be understood that the invention is capable of modification and variation and is limited only by the following claims.

We claim:

1. A reed contact unit for an electric switching function, comprising a metallic contact blank featuring a base with at least one contact arm formed integrally therewith, having long sides and a front end and comprising an electrically non-conducting frame part affixed to the base of the contact blank, and at least one frame shank configured integrally with the frame part wherein at least one of the long sides and the front end of the contact arm is surrounded by at least one frame shank, the front end of the contact arm being releasably fixable in the frame shank.

2. The reed contact unit according to claim 1, wherein the section of frame shank fixing the front end of the contact arm is provided with a groove accommodating the front end of the contact arm.

3. The reed contact unit according to claim 1, wherein the relevant long side of the contact arm is by formation of a clearance surrounded by the frame shank.

4. The reed contact unit according to claim 1, wherein the front end of the contact arm can be disengaged from the frame shank by bending the contact arm.

5. The reed contact unit according to claim 1, wherein the contact arm can be bent out of a plane of an area of frame shank surrounding said contact arm.

6. The reed contact unit according to claim 1, wherein the at least one contact arm is surrounded on both of its long sides and its front end by frame shanks.

7. The reed contact unit according to claim 1, wherein the frame shank formed on the frame part is L-shaped.

8. The reed contact unit according to claim 1, wherein the frame shank formed on the frame part is T-shaped.

9. The reed contact unit according to claim 1, wherein the frame part and the at least one frame shank consist of plastic and are molded to the base, or around the at least one contact arm, of the contact blank.

10. The reed contact unit according to claim 1, wherein the frame shank can be broken off the frame part in the assembly of the reed contact unit.

11. The reed contact unit according to claim 1, wherein a notch is provided between the frame part and the frame shank.

12. The reed contact unit according to claim 1, wherein the frame part or the frame shank is in an assembly operation of the reed contact unit intended as a backing or a guide element in a relevant component.

13. The reed contact unit according to claim 1, wherein each of the contact arms is divided in at least two reed contacts extending parallel in relation to each other.

14. The reed contact unit according to claim 1, wherein several of reed contact units are combined in the way of a strip or stamped pattern, each of said reed contact units being able to be broken off from the strip or stamped blank.

15. The reed contact unit according to claim 1, wherein the strip or stamped pattern is provided with notches separating the reed contact units.

* * * * *